United States Patent [19]

Steinlein

[11] 4,295,576

[45] Oct. 20, 1981

[54] MOLDED CASE FOR RETURNABLE BEVERAGE BOTTLES

[75] Inventor: Rudolf F. Steinlein, Munich, Fed. Rep. of Germany

[73] Assignee: Alexander Schoeller & Co., AG., Switzerland

[21] Appl. No.: 89,304

[22] Filed: Oct. 30, 1979

[30] Foreign Application Priority Data

Oct. 31, 1978 [CA] Canada ..... 315579
Apr. 12, 1979 [DE] Fed. Rep. of Germany ... 7910849[U]

[51] Int. Cl.[3] ..... B65D 1/24
[52] U.S. Cl. ..... 220/21; 206/427
[58] Field of Search ..... 220/21; 206/203, 427

[56] References Cited

U.S. PATENT DOCUMENTS

| | | | |
|---|---|---|---|
| 3,927,789 | 12/1975 | Prodel | 220/21 |
| 4,032,007 | 6/1977 | Graser | 206/427 |
| 4,036,391 | 7/1977 | Prodel | 220/21 |
| 4,067,474 | 1/1978 | Prodel | 206/427 |
| 4,071,162 | 1/1978 | Steinlein | 206/203 |
| 4,210,265 | 7/1980 | Steinlein | 220/21 |

FOREIGN PATENT DOCUMENTS

| | | | |
|---|---|---|---|
| 2556449 | 6/1977 | Fed. Rep. of Germany | 220/21 |

*Primary Examiner*—George E. Lowrance
*Attorney, Agent, or Firm*—Roylance, Abrams, Berdo & Farley

[57] ABSTRACT

A bottle case integrally molded from thermoplastic resin has at least one separator column subdivided into partial pillars rising from the floor of the case for separating bottles in the case sufficiently to prevent breakage in handling and transportation. Each column is subdivided by a gap so that bottles can be accepted together with a carrier or minicase, with one internal wall of one carrier or minicase or one external wall of each of two carriers or minicases being slid into the gap of the column. The pillars have single-webbed profiled walls, the surface of the profiled wall facing the side walls of the box structure being part of side faces of the column and the other surface of the profiled wall being part of the gap configuration. The upper mouth of the gap can be a slot to facilitate insertion of the carrier or minicase and to locate and adjust its walls. Vertical reinforcement corrugations stabilize the pillars. A web of material of reduced length fills the gap between the facing edges of the pillars adjacent the floor. The pillars are anchored to a floor lattice by anchoring points which include at least points located on the outside of the pillars directly opposite inner reinforcement ribs.

12 Claims, 15 Drawing Figures

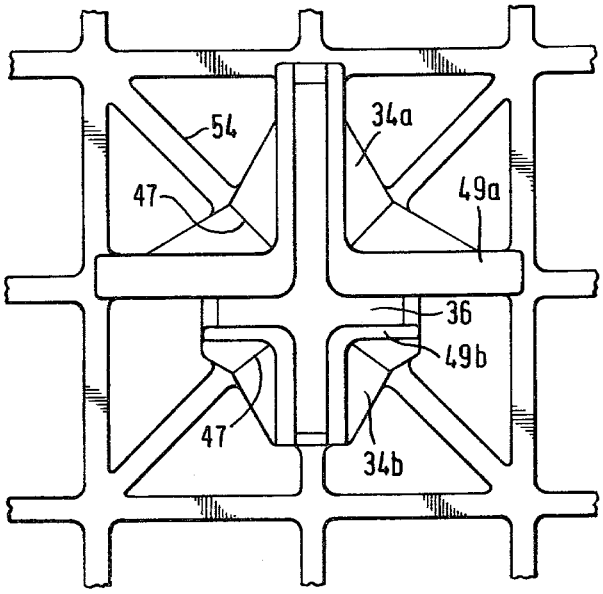
Fig. 10
Fig. 11
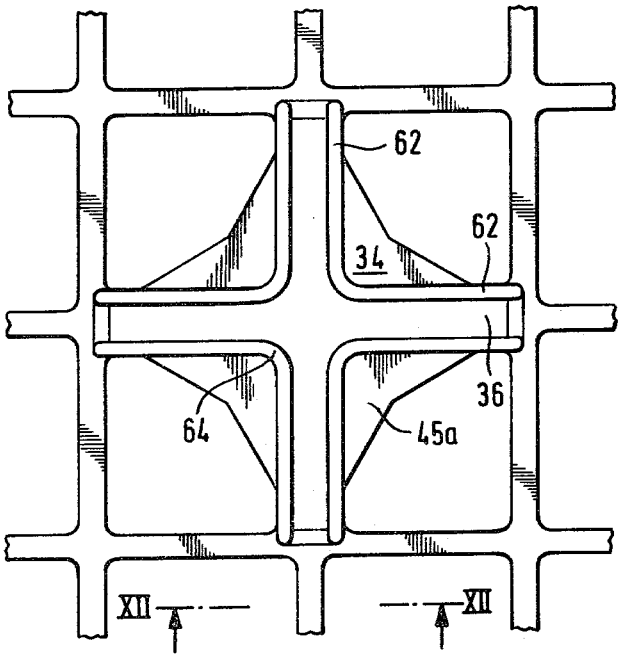

MOLDED CASE FOR RETURNABLE BEVERAGE BOTTLES

The present invention relates to molded thermoplastic resin cases for transport and handling of beverage bottles, and particularly to bottle cases suited to receive bottles which are in a smaller carrier or minicase.

BACKGROUND OF THE INVENTION

Plastic cases for beverage bottles are commonly rectangular and have side walls and a floor which is a latticework of floor support ribs. The floor is made this way to minimize the weight of the case, to minimize any accumulation of debris in the case, and to make it easier to wash out. The inner space in the case is divided in one of several possible ways into bottle receiving compartments suited to the bottle size to be accepted by it.

In one type of case the inner space is divided into compartments by a number of columns which extend vertically from the floor. The columns have a roughly cross-shaped cross-section and are placed so that they each extend vertically in the space between a group of four bottles to keep the bottles spaced sufficiently that they do not break when they are jostled. In some cases of this type, the columns are slotted in at least one direction, parallel with the side walls to form a group of two or four facing double-walled pillars. This permits bottles to be accepted together with a hand carrier, such as a "six-pack" carrier of cardboard. Such a case is described, for example, in U.S. Pat. No. 4,071,162, Steinlein et al, which is assigned to the same assignee as that of the rights to the present invention. One or more walls of the carrier are slid into aligned slots of the columns. The columns enter the carrier through openings in the bottom of the carrier. The columns thereby supplement the protection against breakage which is afforded by the carrier alone. When the bottles are returned empty without the carrier, they can be returned alone to the case and are then similarly protected by the pillars. This protection is very important, since inadequately protected empty bottles can easily develop hair-line fractures which render them unsuitable for refilling, but which are very difficult to reliably detect.

A persistent problem with cases of the type described above which have at least one slotted column has been that with certain configurations of the floor, particularly a cartesian or rectangular floor lattice, the pillars of a column move together after the molding of the case, thereby impairing the loading of a carrier into the case due to insufficient slot clearance for readily accepting the carrier wall in the slot. This reduced slot clearance is a result of warping which occurs upon cooling of the case after unmolding. Yet, for material economy and other structural reasons it is often preferred to use, for instance, a floor configuration of the type described above.

SUMMARY OF THE INVENTION

Briefly described, the invention includes a molded thermoplastic resin case for transporting bottle carriers or minicases filled with beverage bottles or single beverage bottles including a box structure having side walls and a floor, at least one separator column extending upwardly from said floor within said box structure, said column having side faces for separating inserted bottles one from the other and being subdivided into partial pillars by a gap configuration for receiving therein a wall structure of at least one of said bottle carriers or minicases, wherein the improvement wherein each of said pillars is formed from a web-like profiled single wall, one surface of said profiled wall facing the side walls of the box structure being part of said side faces of said column and the other surface of said profiled wall being part of said gap configuration.

BRIEF DESCRIPTION OF THE DRAWINGS

In order that the manner in which the various objects are attained in accordance with the invention can be understood in detail, certain advantageous embodiments thereof will be described with reference to the accompanying drawings, which form a part of this specification, and wherein:

FIG. 10 is a top plan view of another embodiment of a column similar to FIG. 8 with a somewhat modified column shape and with anchoring of the central areas of the outer faces of the pillars in the case floor;

FIG. 11 is a top plan view of another embodiment of a column in which four pillars are provided without central anchoring to the case floor, and wherein the gap-forming walls of each pillar are reinforced relative to each other;

DETAILED DESCRIPTION OF THE DRAWINGS

Figure 1:
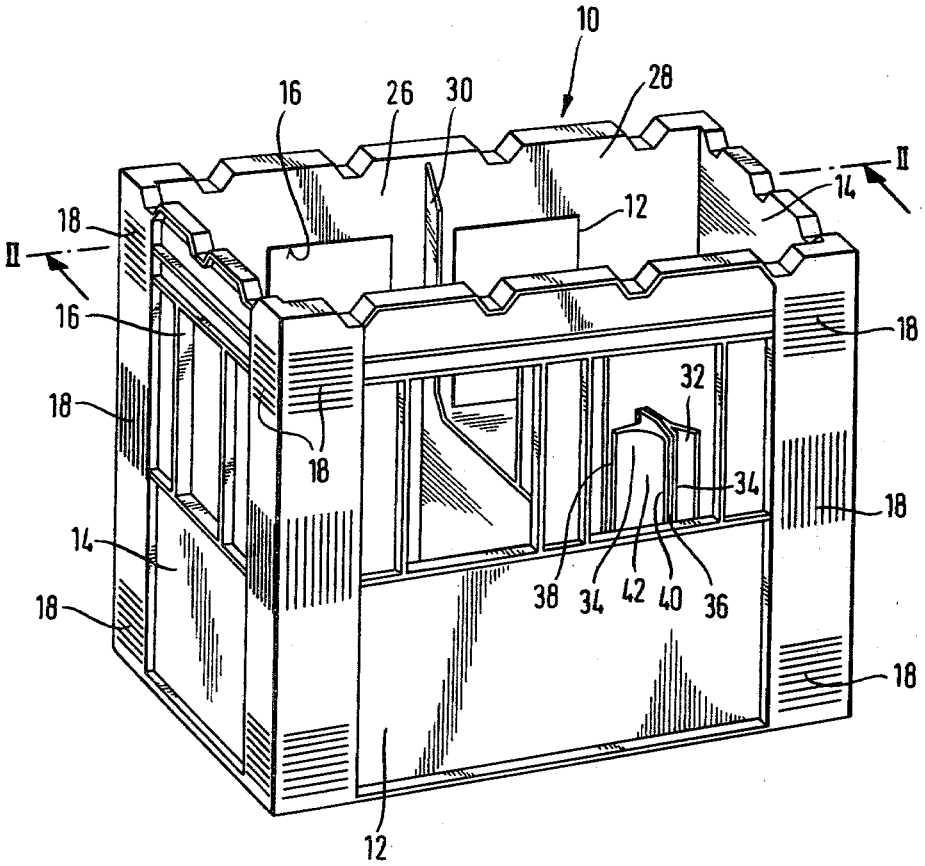
FIG. 1 is a perspective view of a first embodiment of a case in accordance with the present invention.
Figure 2:
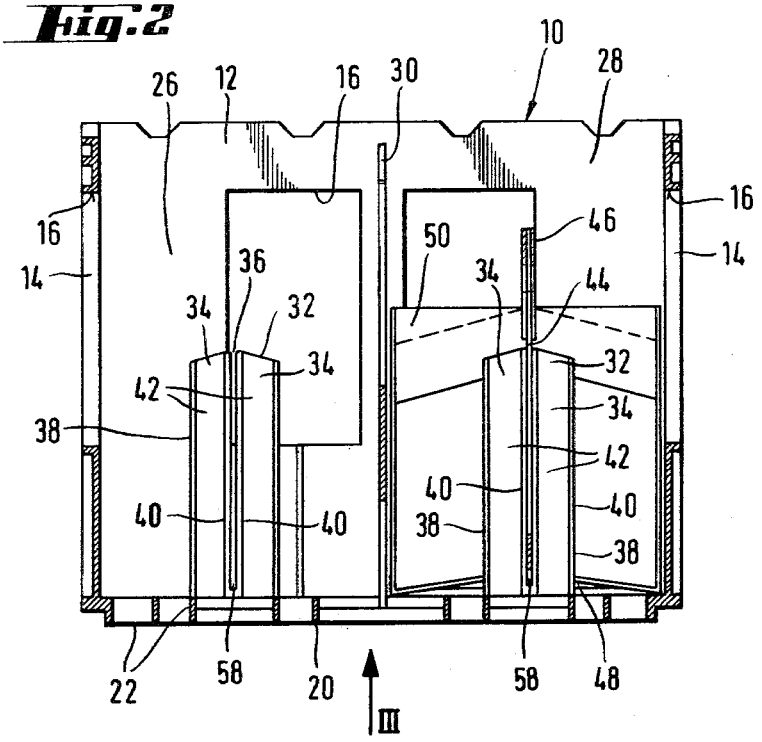
FIG. 2 is a side elevation in longitudinal section of the case of FIG. 1, with a carrier shown in one side compartment.
Figure 3:
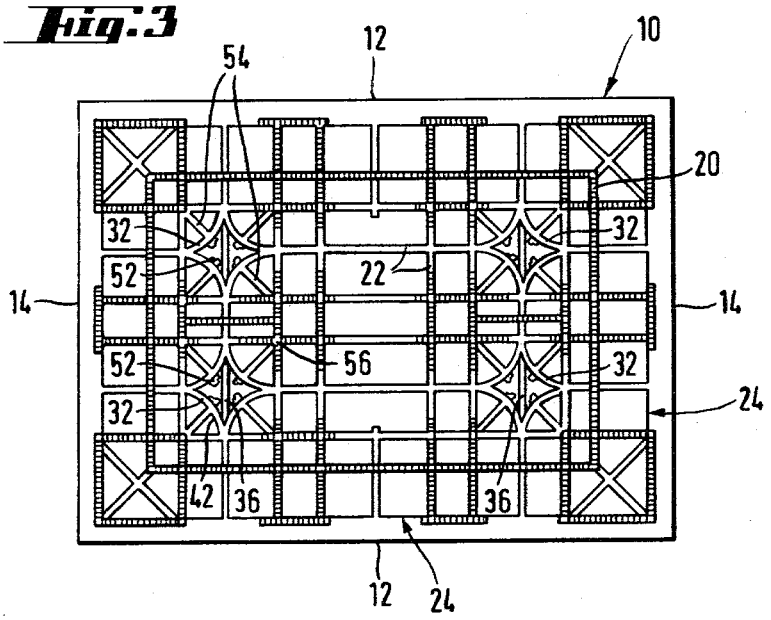
FIG. 3 is a bottom plan view of the case of FIGS. 1 and 2 showing the anchoring of the pillars of the case to the floor lattice.

A first embodiment of the present invention is the case 10 shown in the FIGS. 1–3 of the drawings. Integrally molded case 10 has a rectangular configuration with two elongated side walls 12 which are mutually parallel and spaced from one another and two end walls 14 which join together the ends of the side walls 12. Both the side walls 12 and the end walls 14 have hand holes 16 in them to permit lifting of the case 10 by any wall. At various locations on the side and the end walls 12, 14 there are provided sets of locking ribs 18 which prevent the case 10 from sliding back and forth or up and down relative to another case of a similar nature in contact against it in a stacked arrangement as is used in transport.

Extending between the bottom edges of the side and end walls 12 and 14 is a floor lattice 20, best seen in FIG. 3, which is made up of support ribs 22 running in a generally cartesian pattern, so that the majority of the individual support ribs 22 are either parallel to the side walls 12 or to the end walls 14. The floor support ribs 22 do not extend all of the way to the edges of the side and end walls 12, 14, so that the bottom edges of the side and end walls 12, 14 become shoulders which permit the nesting of the case 10 on another case similar to it. There are additionally provided interlocking channels 24 in the bottom side of the floor lattice support ribs 22 to facilitate nesting of cases in a staggered stacking arrangement for better security in transport.

The interior space of the case 10 is divided into two case compartments 26, 28 of equal size by a case partition 30.

Extending vertically from the floor lattice 20 in each of the case compartments 26, 28 are two aligned columns 32, each subdivided into two closely spaced, single-webbed pillars 34 with a narrow gap 36 between them. Each pillar 34 has a cross-section which is generally T-shaped as seen from the top, establishes a slot configuration at the top of the column and is in the shape of a double-curved bracket elsewhere. Thus each pillar has a spine 38 lying in the plane of the junction of the brackets of the cross-section, and two flanges 40, one to each side of the spine 38. Between the spine 38 and each flange 40 of the pillars 34 is a concave cylindrical face 42 with a radius of curvature suited to the curvature of bottles to be accepted by the case 10 in such a way that at least one line of contact is established. It is not necessary that the radius of face 42 be equal to the bottle radius, the radius of face 42 preferably being larger. It can be visualized that the pillars 34 define, in each case compartment 26, 28, six receiving locations for bottles. The pillars 34 are of such dimensions that the received bottles are separated from each other by them to avoid breakage.

The pillars 34 are spaced from each other so that the gap 36 between them can receive the central partition 44 of a carrier, such as the carrier 46 shown in FIG. 2, or of a minicase, not shown. A pair of openings 48 in the bottom of the carrier 46 permit the pillar groups of columns 32 to extend up into the carrier 46 with the central partition 44 of the carrier 46 lying in the aligned gaps 36. The pillars 34 thereby become located in the individual carrier compartments 50 and afford protection of the bottles in addition to that provided by the carrier 46. When the empty bottles are later returned and placed into the case 10 without the carrier 46, which is generally not returned, the pillars 34 again provide the needed protection. Carrier 46 can be in the nature of a "six pack".

As can be seen from FIGS. 2 and 3, the pillars 34 are single-webbed and profiled in such a way that they are open on their facing sides forming gaps 36. Extending vertically lengthwise on the inner surface of each pillar 34 and midway between the spine 38 and each of the flanges 40 are reinforcing ribs 52. The reinforcing ribs 52 have L-shaped cross-sections, with the long leg of the L lying flat against the inner surface of the pillar 34.

Where each pillar 34 joins the floor lattice 20, it is anchored to a floor support rib 22 at each flange 40 and also at the spine 38. Additionally, there are short diagonal anchoring ribs or webs 54 extending from a support rib intersection to points directly opposite the reinforcement ribs 52 on the inner surface of the pillars 34 along a radius of the faces 42.

The gap space between facing flanges 40 of facing pillars 34 near the floor lattice 20 is filled in by short webs 58. This effectively prevents the slots 36 from extending completely to the floor lattice 20 of the case 10. However, the webs 58 do not interfere with the acceptance of the carrier 46, since carriers commonly have the bottom slightly raised in the center carrier partition region, as can be seen from the illustration of the carrier 46 in FIG. 2.

The configuration of the pillars 34 with open facing sides, the inner reinforcement ribs 52, the webs 58 between the flanges 40 of the facing pillars 34 in the gap 36, and the anchoring of the pillars 34 to the floor lattice 20 at points which include at least points located on the outside of the pillars 34 directly opposite the inner reinforcement ribs 22 results in a structure in which the gap spacing does not warp from the desired value upon demolding. Moreover, the pillars 34 are firmly and ruggedly anchored to the floor lattice 20 so that they can not readily loosen from it. The absence of an inner facing wall for the pillars 34 has the further advantage that the pillars have excellent drainage of washing water in their upside-down position.

It should be understood that the features described above with respect to the preferred embodiment of the invention could also be used where pillars are associated in groups of more than two in order to form a column. For example, it is sometimes desirable to slot a column in both directions, such as would be the case if the pairs of facing pillars described above were also provided with a slot through the spines so that there would be a group of four mutually facing inwardly curved pillars. While the features of the present invention are especially advantageous for cases with cartesion floor lattice patterns, the invention is useful for other floor patterns, such as those having radial sub-patterns.

Figure 4A:
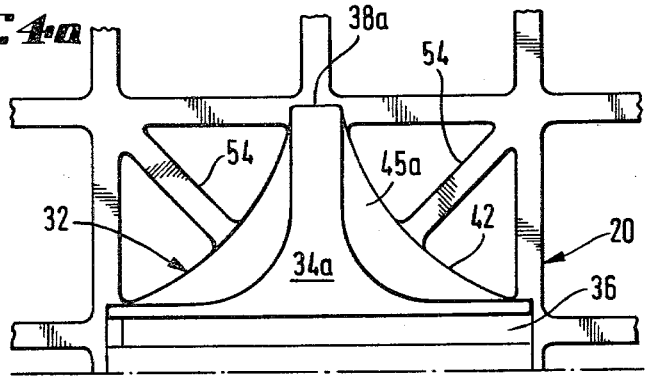
FIGS. 4*a* and 4*b* are enlarged plan views of a section of the bottle case in the area of a column, showing namely in FIG. 4*a* the bottle case according to FIGS. 1 to 3 and in FIG. 4*b* a modified embodiment of the outer faces of the pillars of the column.
Figure 4B:
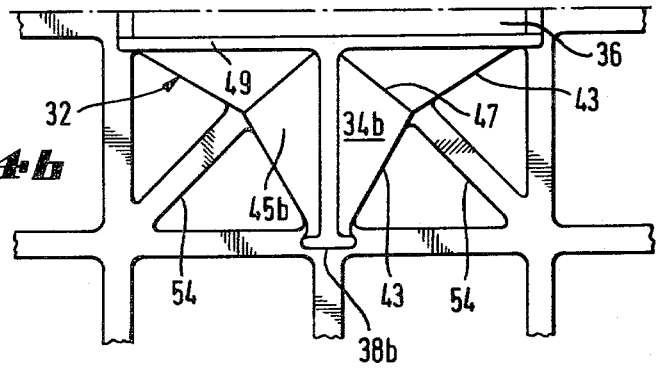

The details of the pillar structure are shown in FIGS. 4*a* and 4*b*, the first embodiment of the column shape discussed in connection with FIGS. 1 to 3 being shown in FIG. 4*a* and a second embodiment of a column structure being shown in FIG. 4*b*, both embodiments being usable in the case shown in FIGS. 1 to 3.

The essential difference between the structures of FIGS. 4*a* and 4*b* is that the contour of the outer faces 42 of the pillar 34, which corresponds to a quarter cylinder face in the embodiment of FIG. 4*a*, is replaced in the embodiment of FIG. 4*b* by two dihedral plane faces of equal width which meet each other at an obtuse angle along a vertical line lying in a plane which bisects the angle between the major flange and spine of the column. Tying or anchoring by anchoring ribs or webs 54 is effected in this embodiment at the junction area of the two plane faces 43, as it was accomplished in the embodiment of FIG. 4*a* in the central area. As shown by the plan view of FIG. 4*b*, the topmost portion of the one-webbed pillar 34*b* is bent outwardly from the slot-shaped upper extremity of the gap 36 so as to form hood faces 45 which are triangular and which slope downwardly and outwardly at the upper end of the column which is part of the one-webbed structure of the pillar. The corresponding structures in FIG. 4*a* are crescent-shaped hood faces 45*a* which terminate at the upper edges of arcuate surfaces 42. The triangular hood faces 45*b* meet each other along an edge 47 which, in prolongation of the anchoring ribs or webs 54, extends up to the slot-defining upper edge 49 of the respective pillar. This upper edge 49 additionally also has an extension branching centrally and rectangularly and extending to the spine 38 of the pillar which is provided as additional reinforcement against bending of the pillar.

Figure 5:
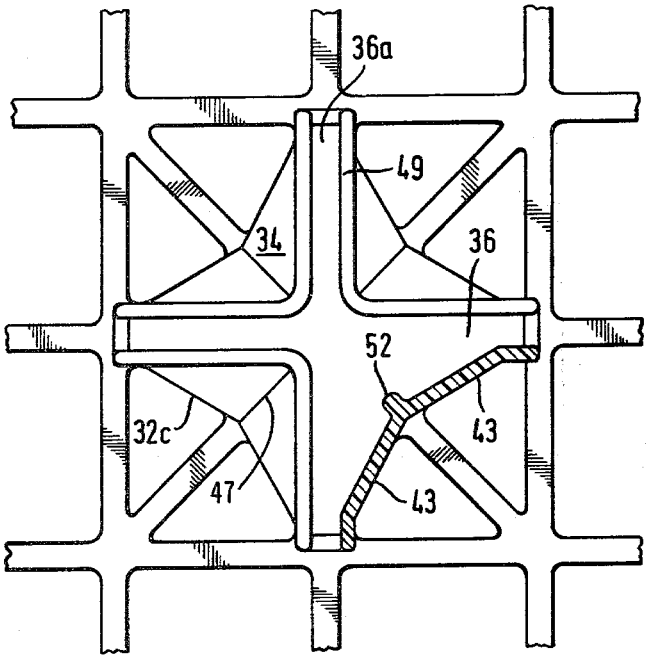
FIG. 5 is a plan view similar to that of FIGS. 4*a* and 4*b* and partly in section showing a futher embodiment of a column structure, the outer faces of the pillars of the column being in accordance with FIG. 4*b*, and including four pillars to form a cross-shaped gap in the column.

In FIG. 5 is shown a further embodiment of the invention modified such that in the column 32*c* a cross-shaped gap 36 is formed which, at the top of the column, is defined by an introduction slot delimited by a plurality of slot-forming upper edges 49, of four pillars 34, substantially forming a rounded right angle. It may be seen in the sectional view in the lower right quadrant of FIG. 5 that the one-webbed structure of each of the respective pillars 34 extends so as to be reset outwardly and downwardly of the upper slotted hood faces, namely into the dihedral plane faces 43. As in the case of FIGS. 1 to 3, these faces are reinforced in their connecting areas by an inwardly protruding vertical reinforcing rib 52.

Figure 6:
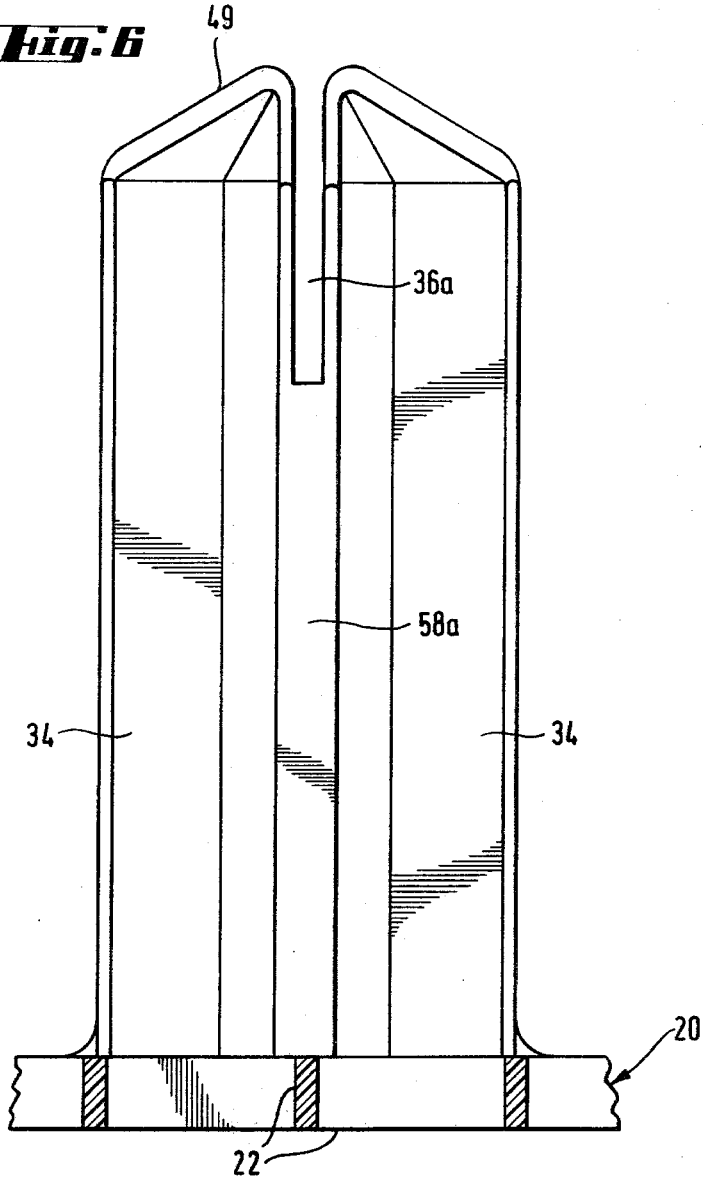
FIG. 6 is a side elevation of the column of FIG. 5, with the case floor in section.

FIG. 6 shows that with the four-armed gap 36 of the two embodiments according to FIG. 5 the two newly added gap arms 36*a* can be formed to extend toward the floor lattice to a much smaller degree so that the two adjacent pillars 34 are interconnected above the upper edge of the web 58 by a rib-shaped web 58*a* which, as shown in the drawing, may even reach to above half the height of the column. This arrangement is possible because the compartment walls of various carriers may reach down to different depths. The final, concrete choice of the height of the webs 58 and 58*a* depends on the special construction of the carriers or minicases to be accepted and may also have dimensions different from those shown.

Figure 7B:
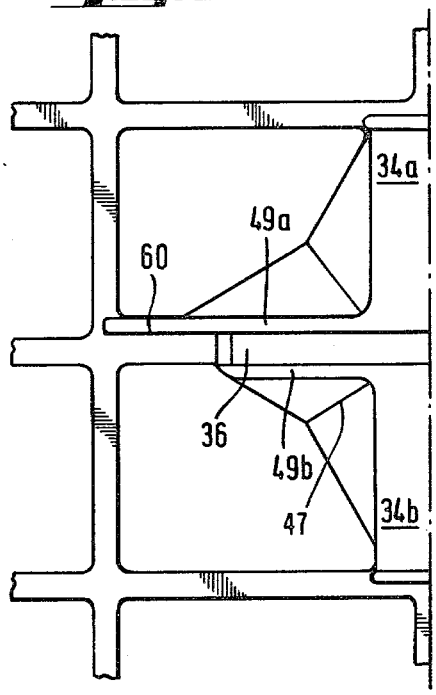
FIGS. 7*a* and 7*b* are top plan views of further embodiments of a column structure having two pillars having different cross sectional shapes such that only one pillar has gap-forming extensions reaching into the area of the centers of bottles to be inserted, FIG. 7*a* having an outer face similar to FIG. 4*a* and FIG. 7*b* having faces similar to FIG. 4*b*.
Figure 7A:
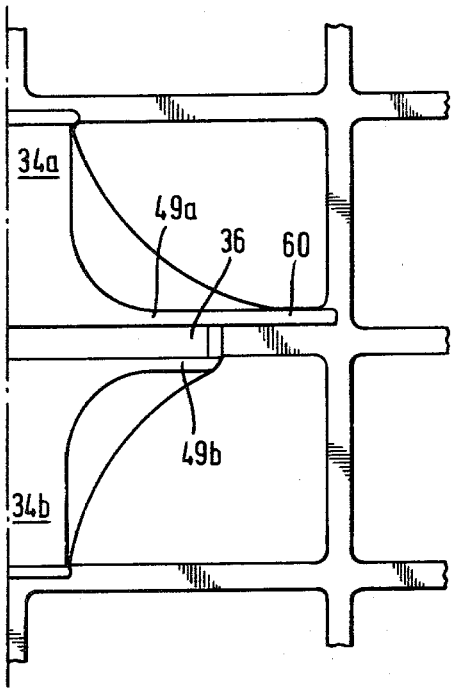

It will be observed that FIGS. 7*a* and 7*b* illustrate the two portions of further embodiments of a column having a single slot, portion 7*a* having an arcuate web arrangement similar to FIG. 4*a* and FIG. 7*b* having dihedral planes similar to FIG. 4*b*. Thus, this figure illustrates two alternative arrangements. For purposes of the following discussion, however, FIGS. 7*a* and *b* can be viewed as a single figure. The relationship between the embodiments shown in FIGS. 7*a*, 7*b* and 8 are generally similar to a large extent, to the embodiments of FIGS. 4 and 5, FIG. 7 having a two-armed gap 36 like FIG. 4 and FIG. 8 having a four-armed gap 36 with rectangular crossing like FIG. 5.

A significant difference will be noted in that the anchoring ribs or webs 54 are omitted, since in many cases additional tying or anchoring of the pillar to the case floor is dispensible. Actually, experience has shown that the one-webbed pillar structure may already be designed to be self-supporting of itself. However, this depends on three-dimensional arrangements, wall thicknesses, types of material and the like.

Figure 8:
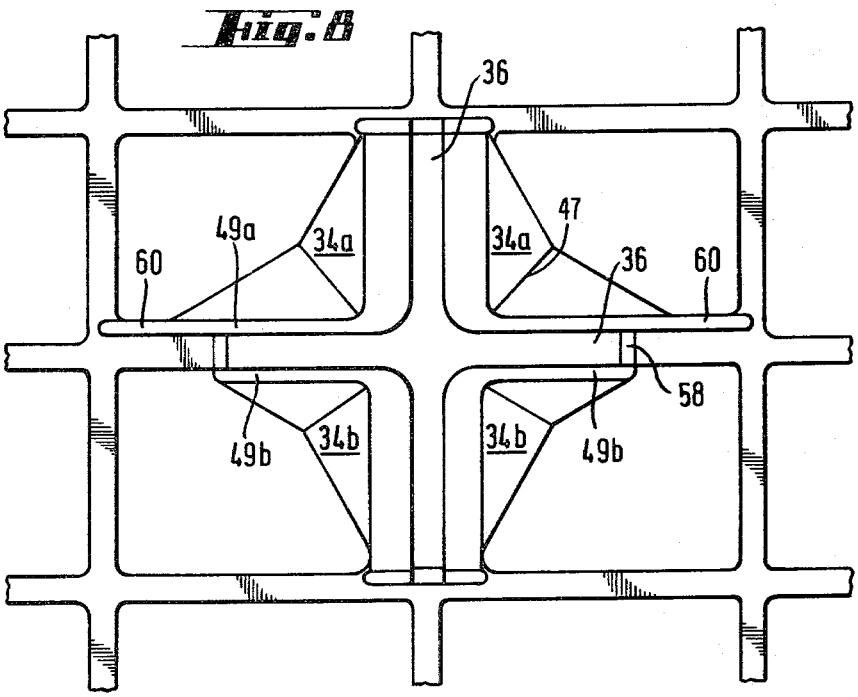
FIG. 8 is a top plan view of a modified form of column similar to FIG. 7*b* wherein four pillars are provided forming a cross-shaped gap within the column.

A second and particularly essential difference as compared to FIGS. 4 and 5, respectively, is that the pillar of the upper half of both of FIGS. 7*a* and 7*b* and the two pillars 34 of the upper half of FIG. 8 shown in mirror symmetry to each other, respectively, have a cross-section differing from that of the respective pillar of the lower half of the drawing of FIG. 7*a* and 7*b* and from those of the respective pillars of the lower half of the drawing of FIG. 8, respectively. For this reason the pillars of the respective upper half of a drawing are provided with the suffix a and the pillars of the lower half of the drawing are provided with the suffix b.

For example, in the pillar 34*a* the slot-forming upper edge 49*a* thereof extends further outwardly than the opposite slot-forming upper edge 49*b* of the other pillar 34*b*. In the protruding area an outer flange 60 is formed which can extend throughout the height of the column and which, downwardly of the slot-forming upper hood area of the column, passes over angularly into the adjacent outer face of the respective pillar 34*a*.

The extension of the outer flange 60, to which no respective outer flange of the opposite pillar 34*b* corresponds, may reach near, or even up to, the projection rectangular to the side walls 12, 14 of the center of a bottle to be inserted beside the respective column. Absolute bottle separation within the bottle case 10 is thereby obtained. This outer flange 60 preferably is a planely designed outer wall portion of the respective one-webbed profiled pillar.

Figure 9:
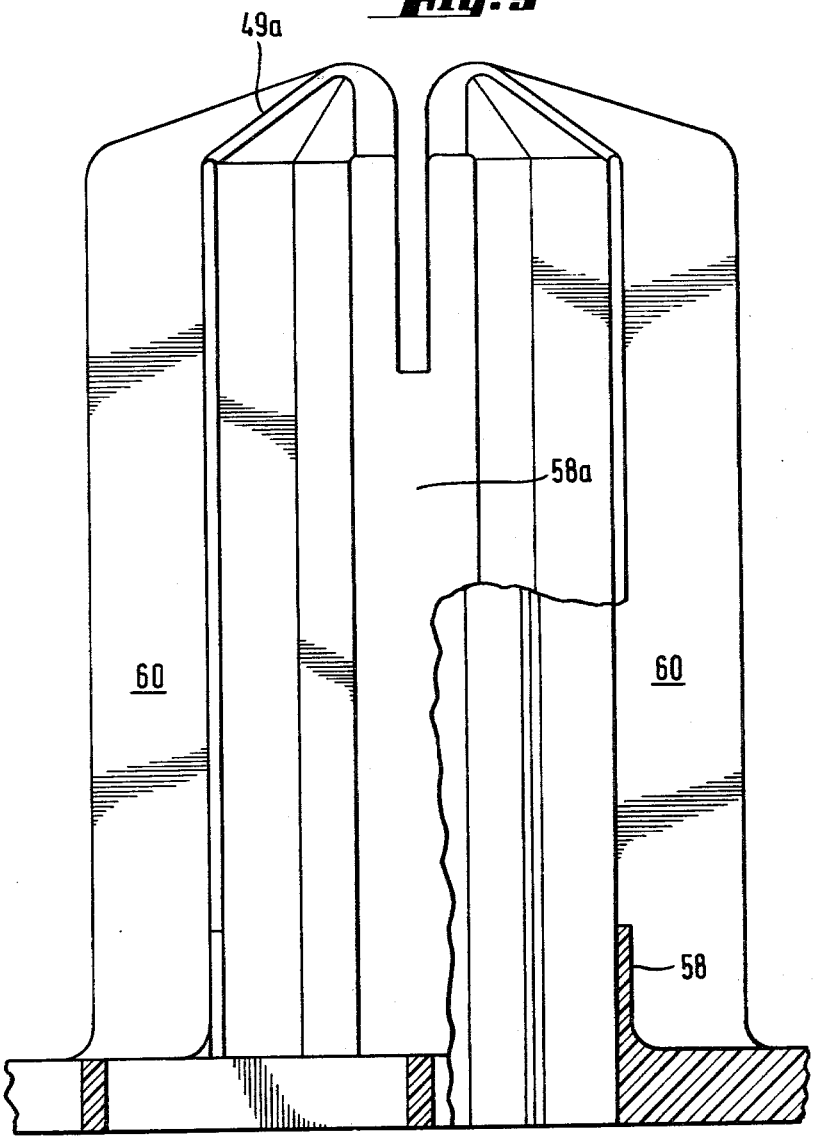
FIG. 9 is a side elevation of the column of FIG. 8 in partial section.

The extension of the outer flange 60 throughout the column is shown in FIG. 9 with regard to the embodiments of FIGS. 7*a*, 7*b* and 8, respectively, as described.

A further embodiment as shown in FIG. 10 differs from the embodiment of FIG. 8, first, in that an anchoring web or an anchoring rib 54 extending along a diagonal is provided, as shown in the earlier embodiments of FIG. 1–5.

A respective modification of FIG. 7 is also possible.

Moreover, the column according to FIG. 10 differs from FIG. 8 in having a broader slot-forming upper edge 49*a* which may be several times broader than the unchanged slot-forming upper edge 49*b* of the pillar 34*b* having the smaller cross-section.

In all embodiments described so far the column has had means defining an upper slot-forming configuration which then was inclined or curved from the slot outwardly in its individual one-webbedly profiled pillars to form a gap 36 having wider dimensions.

Figure 12:
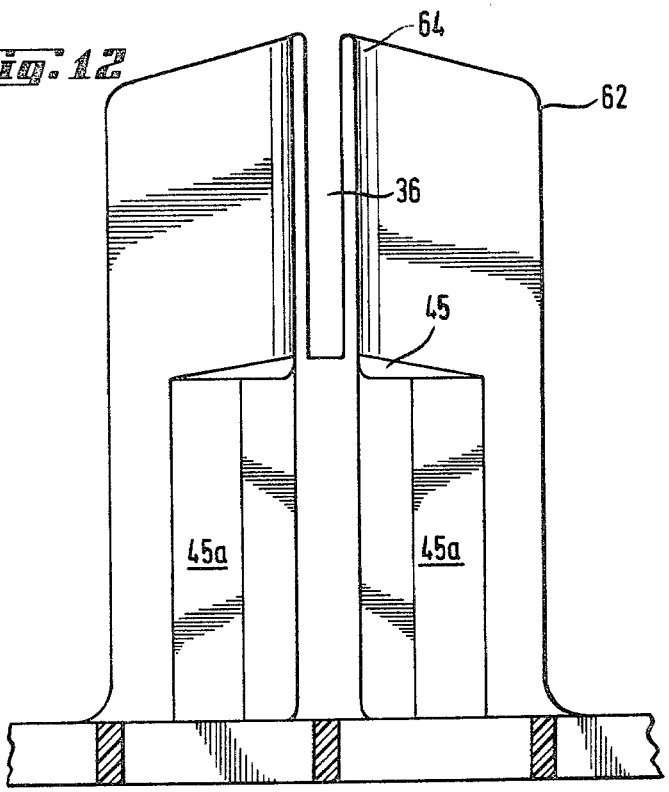
FIG. 12 is a side elevation of the column of FIG. 11 with the case floor shown in section.

By the example of a four-armed gap 36 with rectangular crossing, FIGS. 11 and 12 show that the slot-forming upper edges 49 of the four pillars 34 may also extend vertically downwardly towards the case floor without additional displacement in the horizontal. In this embodiment, then, each pillar consists of two vertical plane walls 62 extending at right angles relative to each other and joining each other in a rounded transition section 64, four such pillars forming a column.

In order to profile this structure such that it becomes self-supporting despite the one-webbed design, for example, one may provide on the outside of the walls 62 and the transition section 64 a reinforcing projection 45*a* which is horizontal or curved or of some other profile, for example, rising in a hood shape from the floor while tapering. Preferably, it has the hood shape mentioned in order to avoid dirt deposition; this also is advantageous as regards reinforcement. In this respect, there is a certain analogy to the hood faces 45 of the aforedescribed embodiments. Depending on the conditions given it is possible to provide the reinforcing projection 45*a* more or less high on the plane walls 62 and the transition section 64 of the respective pillar 34, optionally even only in the foot area of the pillar, though a higher starting point provides better reinforcement.

FIG. 12 shows a side elevation of this variant according to FIG. 11 where the reinforcing projection 45*a* ends at a height about in the middle of column 32 and extends downwardly to the case floor. As shown, the height can be selected such that one arm of the gap 36 begins above the reinforcement 45*a*. However, this is not functionally necessary but may be selected depending on the circumstances. It is obvious from FIG. 12 that, as in the embodiments described before, the actual hood face 45 has a relatively short extension in height and that under it the reinforcing projection 45*a* may just continue with a constant cross-section. Of course, here too variants are possible such as a better adaption to the demolding conditions with respective conical design.

Figure 13:
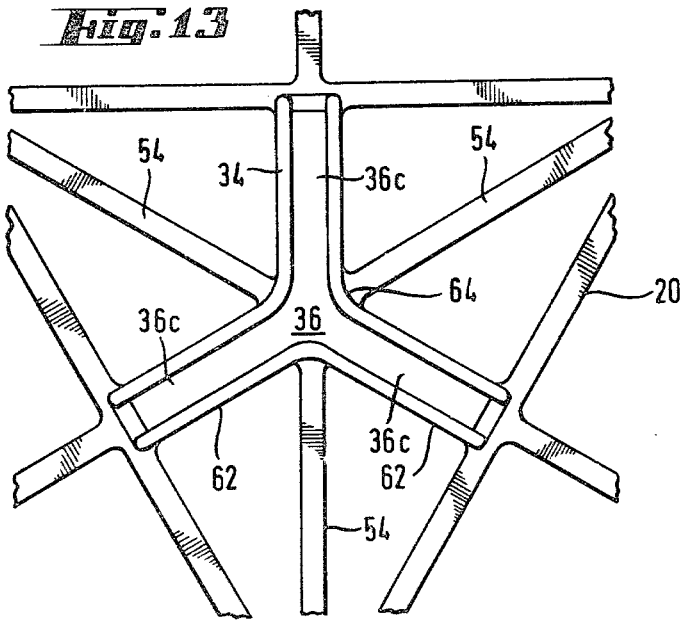
FIG. 13 is a top plan view of a further embodiment of a column comprising three pillars which form a three-armed gap within the column, each pillar being separately and centrally anchored to the case floor.

The last embodiment, shown in FIG. 13 finally is derived from the version of FIGS. 11 and 12 as described in the foregoing. However, here the gap 36 has three gap arms 36*c*. The angles between the three gap arm centerlines 36*c* are equal. As in the embodiments described above, the reinforcing projections 45*a* are replaced by tying or anchoring to the floor lattice 20 of the case floor which, in this embodiment, is not of cartesian configuration but of an angular configuration corresponding to the different subdivision into compartments, by means of anchoring ribs or webs 54 which again engage at the middle of the two main walls, formed by plane walls 62 with rounded transition section 64, of each of the three pillars 34 which are identical here. The anchoring is effected to the respective transition section 64.

Finally, it should be noted that the various embodiments described are each of a design identical to that of the embodiment to which reference is made expressly in each case. However, within the scope of the invention all possibilities of variation described may arbitrarily be combined in addition to the described embodiments so that, for example, in FIG. 13 as well as in FIG. 7, 8 or 10 outer flanges 60 may only be provided on one or several of the pillars given to which in each case a respective outer flange on the opposite pillar does not correspond.

As will be recognized from the foregoing, the pillars and eventually their attachment to the floor of the cases of the present invention are such that there is no significant dimensional change of the gap between the pillars of one column after case unmolding. Several features in combination provide the dimensional stability for the gap or slot. The single-webbed profiled pillars are open on their facing sides and have preferably inner reinforcement ribs extending upwards. Near the bottom of the gap and on each side there is a short web filling in the gap. The anchoring points which fix the pillars to the floor include at least points located on the outside of the pillars directly opposite the reinforcement. Terms like "single-webbed profiled pillars" or "web-like profiled single wall" are to be understood as defining a web-like structure forming a single wall as compared to a double-walled structure, as to be seen in the mentioned U.S. Pat. No. 4,071,162.

What is claimed is:

1. A molded thermoplastic resin case for transporting bottle carriers or minicases filed with beverage bottles or single beverage bottles, including:

a box structure having side walls and a floor; and at least one separator column extending upwardly from said floor within said box structure, said column being subdivided into partial pillars defining a slot therebetween for receiving therein a dividing wall of a bottle carrier or minicase with bottles contained therein to be inserted into the case;

each of said pillars being formed from a web-like, profiled, single wall having opposed inner and outer surfaces, said outer surface of each said profiled wall facing said side walls of said box structure and forming concave, vertically extending bottle contact faces for separating bottles inserted in said box structure, said inner surface of each said profiled wall defining said slot at a top portion thereof.

2. A molded thermoplastic resin case according to claim 1, wherein upper edges of said inner surfaces of said partial pillars define vertical planes defining said slots, said bottle contact faces being spaced from respective vertical planes by a distance greater than the thickness of said profiled walls.

3. A molded thermoplastic resin case according to claim 2, wherein said top portions of said profiled walls are connected to said bottle contact faces thereof by sloping, concave hood members.

4. A molded thermoplastic resin case according to claim 1, wherein said top portions on only one side of said slot have lateral extensions to provide further bottle separation.

5. A molded thermoplastic resin case according to claim 1, wherein said partial pillars have reinforcing projections extending upwardly from said floor on said outer surfaces.

6. A molded thermoplastic resin case according to claim 1, wherein said bottle contact faces comprise sections of cylinders.

7. A molded thermoplastic resin case according to claim 1, wherein each said bottle contact face comprises two dihedral planes.

8. A molded thermoplastic resin case according to claim 1, wherein said column is subdivided into only two pillars.

9. A molded thermoplastic resin case according to claim 1, wherein said column is subdivided into four pillars to define two slots which are perpendicularly oriented.

10. A molded thermoplastic resin case according to claim 1, wherein different pillars of one column have different cross sections such that only one of said profiled walls extends between the centers of two adjacently inserted bottles.

11. A molded thermoplastic resin case according to claim 1, wherein longitudinal reinforced ribs are disposed along the center lines of said inner surfaces of said profiled walls.

12. A molded thermoplastic resin case according to claim 1, wherein each of said pillars comprises two concave bottle contact faces meeting along a common spine.

* * * * *